US008544245B2

(12) United States Patent
Ehrmann et al.

(10) Patent No.: US 8,544,245 B2
(45) Date of Patent: Oct. 1, 2013

(54) PACKAGING MACHINE FOR MULTILAYER LID FOIL

(75) Inventors: Elmar Ehrmann, Bad Groenenbach (DE); Dieter Holzem, Erolzheim (DE); Helmut Sparakowski, Tannheim (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 417 days.

(21) Appl. No.: 12/778,196

(22) Filed: May 12, 2010

(65) Prior Publication Data

US 2010/0287881 A1 Nov. 18, 2010

(30) Foreign Application Priority Data

May 13, 2009 (DE) ..... 10 2009 020 898

(51) Int. Cl.
*B65B 47/02* (2006.01)
*B65B 47/00* (2006.01)

(52) U.S. Cl.
USPC ..... 53/559

(58) Field of Classification Search
USPC ..... 53/453, 559
See application file for complete search history.

(56) References Cited

U.S. PATENT DOCUMENTS

| | | | |
|---|---|---|---|
| 3,956,867 | A | 5/1976 | Utz et al. |
| 6,408,598 | B1 | 6/2002 | Stockley, III |
| 6,698,165 | B1 | 3/2004 | Natterer |
| 2003/0196412 | A1 | 10/2003 | Foulke, Jr. |
| 2009/0025340 | A1 | 1/2009 | Natterer et al. |

FOREIGN PATENT DOCUMENTS

| | | | |
|---|---|---|---|
| DE | 39 18 261 | A1 | 12/1990 |
| DE | 199 15 040 | A1 | 10/2000 |
| EP | 0 314 546 | A1 | 5/1989 |
| EP | 0314546 | A1 | 5/1989 |
| EP | 0 769 454 | A1 | 4/1997 |
| EP | 1 043 234 | A1 | 10/2000 |
| EP | 1 147 048 | B1 | 10/2001 |
| EP | 1147048 | B1 | 10/2001 |

(Continued)

OTHER PUBLICATIONS

Extended European Search Report Dated Jul. 14, 2011, Application No. 1100341.2-2308, Applicant MULTIVAC Sepp Haggenmueller GmbH & Co. KG, 4 Pages.
German Office Action Dated Mar. 23, 2010, Applicant Multivac Sepp Haggenmueller GmbH & Co. KG, Application No. 10 2009 020 898.4-27—3 Pages.

(Continued)

*Primary Examiner* — M. Alexandra Elve
*Assistant Examiner* — John Paradiso
(74) *Attorney, Agent, or Firm* — Brooks Kushman P.C.

(57) ABSTRACT

A deep-drawing packaging machine (1) includes a forming station (2) for forming containers (14) in a first web-like material (8), an insertion section (15) for inserting products (16) which reach at least one sealing level (28) or project over it, and a sealing station (3) arranged downstream thereof in a working direction (R) which is embodied to seal a second web-like material (10) onto the containers (14). The packaging machine further includes a means (11) for changing a distance (12) of layers (10*a*, 10*b*) of the second, at least two-layered web-like material (10). In another embodiment, a packaging machine includes an insertion section (15) and a sealing station (3) arranged downstream thereof in the working direction (R), in which at least one contact (25) is provided for thermal transfer via heat conduction between a sealing plate (22) and a heating plate (23) for heating a lid foil (10).

35 Claims, 7 Drawing Sheets

(56) References Cited

FOREIGN PATENT DOCUMENTS

| | | | |
|---|---|---|---|
| FR | 2 725 692 | A1 | 4/1996 |
| FR | 2725692 | A1 | 4/1996 |
| FR | 2 826 336 | A1 | 12/2002 |
| FR | 2826336 | A1 | 12/2002 |
| WO | 2006/087125 | A1 | 8/2006 |
| WO | 2007/118661 | A1 | 10/2007 |

OTHER PUBLICATIONS

German Search Report Dated Sep. 30, 2010, Applicant Multivac Sepp Haggenmueller & Co KG, Application No. 1004250.6-2308, 6 Pages.

European Search Report Dated Feb. 18, 2011, Applicant MULTIVAC Sepp Haggenmueller GmbH & Co. KG, Application No. 10004250.6-2308 / 2251265, 6 Pages.

PACKAGING MACHINE FOR MULTILAYER LID FOIL

CROSS-REFERENCE TO RELATED APPLICATIONS

This application claims foreign priority benefits under 35 U.S.C. §119(a)-(d) to German patent application number DE 102009020898.4, filed Mar. 13, 2009, which is hereby incorporated by reference in its entirety.

TECHNICAL FIELD

The present disclosure relates to packaging machines for manufacturing packages for products.

BACKGROUND

A machine may be used to manufacture packages, in particular packages for fresh meat products, which on the one hand should have a long shelf life and on the other hand should still look attractive to customers in the sales display. To make a fresh meat product look attractive, a corresponding oxygen content at the product surface is required to achieve the attractive reddening.

To achieve this, there are two well-known methods: On the one hand, one lid foil can consist of a material that is impermeable to oxygen, and the interior of the package is (re) gassed with oxygen before it is sealed, thus taking care that there is an oxygen content of more than 60% after the package has been closed. This high oxygen concentration provides a long shelf life as well as a permanent reddening of the product surface.

An alternative method consists in the use of a tray filled with the product which is sealed with two lid foils, one outer lid foil impermeable to oxygen, and one inner lid foil permeable to oxygen, wherein the interior of the package is evacuated and the product achieves a long shelf life thanks to the low residual oxygen. The discoloration occurring in this case is optically imperfect, but it is corrected before the package is placed in the sales display by removing the outer lid foil impermeable to oxygen as now oxygen can diffuse into the package through the inner lid foil permeable to oxygen, resulting in a renewable reddening of the product mainly in the visible region.

Both methods are preferably suited for a combination of package and product, in which the product as a whole is located below the upper edge (equivalent to the sealing level) of the package tray into which it was filled. If a portion of the product surface would be located above the sealing level, the lid foil would contact the product there and the oxygen from inside the package, or also the oxygen diffusing from outside, would not be able to reach these surfaces. Thus, undesired discolorations are formed there at the product which the buyer of this product judges as being imperfect.

The document EP 0 690 012 B1 describes a two-layered foil with an outer layer impermeable to oxygen and an inner layer permeable to oxygen which is suited to diffuse oxygen to the product in spite of a product contact. This effect is generated by particles, preferably food starch particles, being located between the two layers as uniformly distributed as possible, the particles taking care that oxygen can move in this intermediate area and thus continuously continue flowing to the points where oxygen is consumed due to product contact. The oxygen altogether consumed in this intermediate area is enriched again by the quantity of oxygen inside the package and by the lid foil permeable to oxygen.

Such multilayer foils often also have shrink properties that require stability in trays which is provided by the common rolled edge in trays. Therefore, today tray sealers are known which seal trays filled with projecting products with said two-layered lid foils.

A disadvantage of tray sealers compared to deep-drawing packaging machines is the cost for stock-keeping of the trays to be processed, the missing value added in own production due to the purchase of these trays as well as the possible higher power density of the number of packages per time unit.

To let the shrinking capacity of the lid foils become effective, it must be heated to a minimum temperature before it is sealed with the tray and before the chamber is subsequently aerated, so that in this state the foil lies against the product in partial areas as "a second skin" and thus represents a very attractive package. It is well-known to the person skilled in the art to heat for this purpose lid foils in a sealing station by placing them against a plate to achieve the required temperature which makes the shrinking properties become effective. However, this temperature is below the sealing temperature of the sealing plate or the foil, respectively.

A complex and expensive solution is a separate heating means disposed in the plate, which on the one hand requires space and on the other hand requires efforts for leading the energy line for the heating means outside in such a way that the tightness of the chamber in the closed state, e.g. for the evacuation process or sealing, is not annulled.

Simpler constructions provide a plate which is to be brought to the desired temperature only by the radiant heat of the sealing plate. This is mainly disadvantageous when the packaging machine is being started, for example after it has been reset for a new package or a new product, as a very long waiting time results. Moreover, this process is not controlled but requires that then the radiant heat corresponds to the heating of the plate in the subsequent running operation.

SUMMARY

It is the object of the present disclosure to develop an inexpensive packaging machine which nevertheless offers a possibility of eliminating the above mentioned disadvantages.

A deep-drawing packaging machine according to the present disclosure includes a forming station to form containers in a first web-like material, here as bottom foil, into which products are inserted in the region of an insertion section, which can in particular have the property of projecting over the upper edge of the formed containers. Following in the working direction, which corresponds to the direction of transport of the containers formed in the bottom foil, a sealing station is arranged in which a second web-like material as lid foil, in particular a multilayer lid foil, is sealed onto the container and closes the same. The distance between at least two layers of the multilayer lid foil is changed beforehand. This has the advantage in case of multilayer lid foils that a gas cushion can form between adjacent layers to take care that the outer lid foil cannot directly contact the product.

In one embodiment, the lid foil can consist of an outer layer impermeable to oxygen and an inner layer permeable to oxygen. In this case, the gas cushion between the layers can be used to permit or improve, respectively, the oxygen flow between the two layers. Thus, the oxygen can securely reach those points where the product with the inner layer permeable to oxygen is in contact with the product or lies against it, so that a discoloration in particular of the fresh meat product is prevented or at least minimized.

The gas cushion can be formed in particular by the two layers of the lid foil reducing their distance in the direction of transport and being conveyed into the sealing station close to each other and in parallel.

In the region of the sealing station, a closed volume in which the gas cushion is thus located can be generated by the closing of the chamber and clamping in the complete outer edge region (on all sides).

In case of layers of the lidding foil which lie against each other in particular due to adhesion, it is advantageous to space them apart by a means in a first step, to be able to subsequently reduce the distance again. The gas cushion formed thereby can provide a good transport of oxygen within at least two adjacent layers of the lid foil.

This process preferably takes place in the region after the lid foils have been reeled off above or next to the sealing station and before the common transport into the sealing station. This results in the advantage of a small space requirement and of no negative influence on the total design of the deep-drawing packaging machine. To reduce or even exclude negative influences due to moisture that can be present in the surrounding area, this region can also be encapsulated by a separate chamber to be able to generate a separate, preferably dry atmosphere.

Advantageously, the at least two layers of the lid foil are reeled together on a foil roller as web accumulator and can thus be together unreeled from this roller on the deep-drawing packaging machine. This only requires an existing standardized foil take-up for the lid foil. Moreover, the operator cannot confuse the foils in the combination of two lid foils with different properties during the set-up operation. As an alternative, the layers of the lid foil could also be stored individually on different rollers and be brought together subsequently.

Two layers of lid foils located on a common foil roller can be separated or opened, respectively, after they have been reeled off from the foil roller. This means that the layers of the lid foil lying against each other due to adhesion or other connections, such as adhesive layers, are removed from each other. This connection must be released so that a gas cushion with oxygen can be formed between these two layers for the subsequent process. In a preferred manner, small particles, such as cornstarch flour, are located between the layers to be able to minimize adhesion that can occur in the roller in the reeled state and to keep the forces for separating the layers small. Thus, only small tensile loads occur during the transport of the lid foils. As these foils can also have thicknesses of less than 50 μm, higher tensile loads could distort the foil, resulting in wrinkles or even in initial tearing or tearing off.

To prevent shrinkable lid foils from contracting the package itself in an uncontrolled manner and from thus producing an optically imperfect package due to the occurring tensile loads, the formed package tray must be designed such that the package cannot contract. This can be achieved by a strong and stable foil, which, however, involves an increased material demand and thus also increased costs. In a normal foil, lateral reinforcing ribs introduced in the tray bottom are necessary, which, however, do not always satisfy an attractive appearance and can moreover offer, even in the region of the sealing level, only within limits the required stability against lateral forces due to the shrink property of the lid foils. It is known from WO 2007/118661 A1 that a special shape of the upper tray edge by forming an approximate U-shape is suited for being manufactured on a deep-drawing packaging machine and also for being able to offer the required stability for the application described herein.

Due to the particular demand on a long shelf life of fresh meat products, it can be necessary to create a modified atmosphere inside the sealing chamber before the package is closed, which can be preferably accomplished by gas exchange to achieve an atmosphere inside the package with an oxygen content of above 60 percent by volume.

To be able to provide individual packages for further processing, such as weighing, checking for metal residues or foreign matters by metal detectors or X-ray apparatuses, or further packaging into cardboard boxes, a separation of the packages from the first web-like material, which is conveyed within the deep-drawing packaging machine in the working direction via the conveyor chain, is required. This can be realized by preferably cross and longitudinal cutting stations which are located downstream of the sealing station in the working direction. As an alternative, a complete cut is also possible.

To activate the shrink property of the lid foil, it can make sense to heat the lid foil to a certain temperature range which is required for the shrinking process after sealing onto the container. For this, heating plates are used in a standard case which are preferably located in the sealing station and which are heated in a controlled manner to effect the heating of the lid foil. It proved to be particularly advantageous to equip the heating plate with at least one contact for thermal transfer by heat conduction from the sealing plate. It turned out that this can be produced in a particularly simple and inexpensive way as no separate heating means have to be mounted to or in the heating plate of which the energy line then must be elaborately lead out of the chamber of the sealing station mainly with insulation. Moreover, the space requirement for the heating plate can be optimized here. Machines are known in which the heating of the heating plate is only effected by the radiant heat of the sealing plate as the heating plate is usually designed to be insulated via air to the sealing plate and an upper sealing tool part. This conventional heating has a particular disadvantageous effect during the start of the packaging machine, e.g. after a set-up operation, as the waiting time until the start of production is extended. By the temporary direct contact between the sealing plate and the heating plate according to the invention, this waiting time can be reduced to a minimum. A sealing plate does not have to have a one-piece design, it can also be a heating plate with connected webs for sealing, possibly with a separate movability of the webs relative to the heating plate.

The contact between the heating plate and the sealing plate is preferably designed to be releasable, so that the heating plate can also cool down if, for example, after the set-up operation for another lid foil with a different property, the temperature range of the heating plate is to be reduced. Furthermore, it is advantageous to achieve a cooling of the heating plate by separating the contact, as in case of a set-up or cleaning operation, the operators can touch the surface of the heating plate with parts of their bodies, and by this measure, the risk of injury can be reduced, or the waiting time during which the heating plate reaches an uncritical temperature can be reduced.

In a preferred embodiment, the releasability of the contact can be realized by means of a relative movability of the heating plate, the sealing plate and/or contact elements. These movements can be designed in a structurally simple and inexpensive manner if the heating plate and the sealing plate anyway perform linear movements for the process of sealing in the sealing station. An embodiment of the present disclosure permits a linear vertical movement of the sealing plate to the heating plate within the sealing station which is suited to bring the sealing plate in releasable contact with the heating plate.

This movement can be already performed when the chamber is opened to heat the heating plate to the required temperature for the process of sealing to optimize the cycle time of the sealing operation and increase the performance of the packaging machine.

In a preferred way, the heating of the lid foil can also be accomplished by direct contact at the heating plate to heat the lid foil to the required temperature within a period as short as possible to continue with the subsequent processes and to optimize the throughput, here as packages per time unit. For this, by the creation of a vacuum between the lid foil and the heating plate by means of at least one vacuum line while the sealing station is closed, it is possible to place the lid foil approximately flatly against the heating plate to achieve optimal thermal transfer into the lid foil.

To control the temperature of the heating plate to a desired temperature range for the thermal transfer into the lid foil required for the application, preferably at least one sensor is provided at or in the heating plate. Thus, an exact temperature detection of the heating plate can be realized.

Advantageously, the packaging machine is equipped with controlling means to perform at least the control of the temperature of the heating plate. This can also be able to store the product-specific data and/or the temperature-specific data for the lid foil and to retrieve them again in repeated productions and to let the control for the heating of the heating plate run automatically.

Via the connection of the sensors with the controlling means, the process of the temperature control can lead to a precise temperature in and/or at the heating plate.

In a particularly preferred manner, the packaging machine can be designed as a deep-drawing packaging machine which can be equipped with means for separating and bringing together a shrinkable multilayer lid foil and with the heating of the lid foil in the sealing station by means of a heating plate required for this, which can be temperature-controlled via thermal transfer by contact with the sealing plate.

Below, one advantageous embodiment of the present disclosure will be illustrated more in detail with reference to the accompanying drawings.

DETAILED DESCRIPTION

Figure 1:
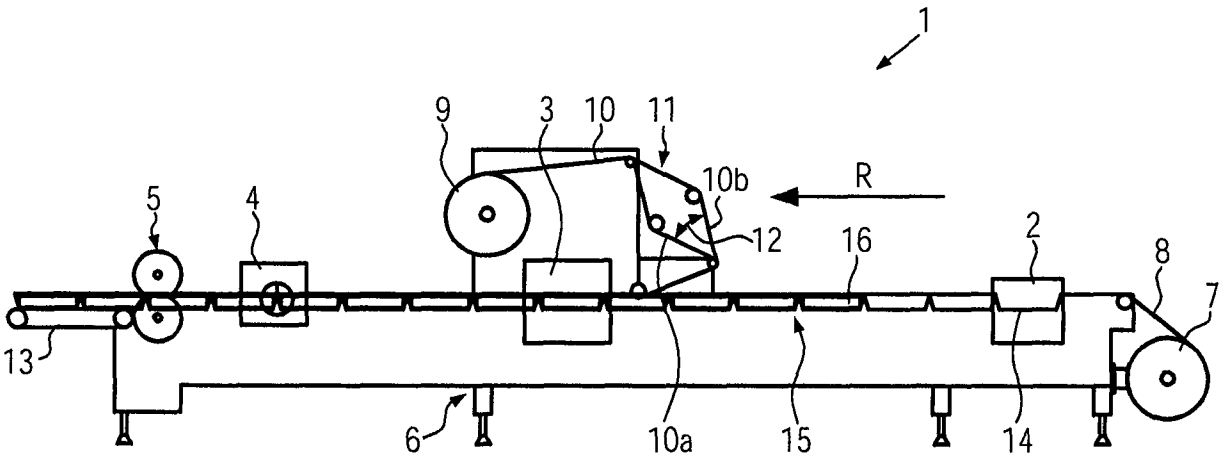
FIG. 1 is a schematic side view of a deep-drawing packaging machine according to the invention.

Equal components are always provided with equal reference numerals in the figures.

FIG. 1 shows in a schematic view a packaging machine 1 according to the present disclosure in the form of a deep-drawing packaging machine. It comprises a forming station 2, a sealing station 3, a cross cutter 4 and a longitudinal cutter 5 which are arranged at a machine frame 6 in a working direction R in this sequence. At the entry side, a feed roller 7 is disposed at the machine frame 6 from which roller a first web-like material 8 is reeled off. In the region of the sealing station 3, a web accumulator 9 is provided from which a second web-like material 10 is reeled off as lid foil. A means 11 for changing a distance 12 of an outer layer 10*a* and an inner layer 10*b* of the lid foil 10 is located upstream of the sealing station 3 in the direction of transport of the second web-like material 10. On the exit side, a discharge means 13 is provided at the packaging machine in the form of a conveying belt, by means of which finished, separated packages are carried away. Furthermore, the packaging machine 1 comprises a non-depicted feed means which laterally grips the first web-like material 8 and intermittently transports it further into the working direction R in the main cycle. The feed means can be realized e.g. by laterally arranged conveyor chains or any other suitable conveyor device.

In the shown embodiment, the forming station 2 is embodied as a deep-drawing station in which containers 14 are formed by deep-drawing in the first web-like material 8. The forming station 2 can be designed such that several containers are formed next to each other in the direction perpendicular to the working direction R. An insertion section 15 is provided downstream of the forming station 2 in the working direction R, in which the containers 14 formed in the first web-like material 8 are filled with the product 16.

The sealing station 3 is designed as closable chamber in which the atmosphere can be evacuated in the containers 14 before sealing and subsequently replaced by a suited exchange gas by regasification.

The cross cutter 4 is embodied as a punching machine which cuts the first web-like material 8 and the second web-like material 10 between adjacent containers 14 in a direction transverse to the direction of transport R. In the process, the cross cutter 4 operates such that the first web-like material 8 is not divided over the total width, but is not cut in two at least in an edge region. This permits a controlled further transport by the feed means.

The longitudinal cutter 5 is embodied as a cutter arrangement in the represented embodiment by means of which the first web-like material 8 and the second web-like material 10 are cut in two between adjacent containers 14 and at the lateral edge of the first web-like material 8, so that there are separated packages downstream of the longitudinal cutter 5.

A controlling means 17, such as an electronic controller, takes over the task of performing and monitoring the processes required in the packaging machine.

The operating process of the above-described packaging machine will be represented in the following.

The first web-like material 8 is reeled off from the feed roller 7 and transported into the forming station 2 by the feed means. In the forming station 2, containers 14 are formed in the first web-like material 8 by deep-drawing using a forming tool or mold, for example. In a main cycle, the containers 14 are transported, together with the surrounding material of the first web-like material 8, further to the insertion section 15, where they are filled with the product 16.

Subsequently, in the main cycle, the filled containers 14 are transported, together with the material of the first web-like material 8 surrounding them, further into the sealing station 3 by the feed means. The second web-like material 10 is transported further as lid foil after a first initial sealing process to the first web-like material 8 with the feed motion of the first web-like material 8. In the process, the second web-like material 10 is reeled off from the web accumulator 9 and moved along the means 11.

The means 11 causes a spacing apart between the outer layer 10*a* of the lid foil 10 and the inner layer 10*b* of the lid foil 10 to a distance 12. Towards the end of the means 11 in the direction of transport, the distance is reduced such that both layers are transported further to the sealing station 3 together and in parallel.

In this manner, an air cushion is formed between the outer layer 10*a* of the lid foil 10 and the inner layer 10*b* of the lid foil 10.

Figure 2:
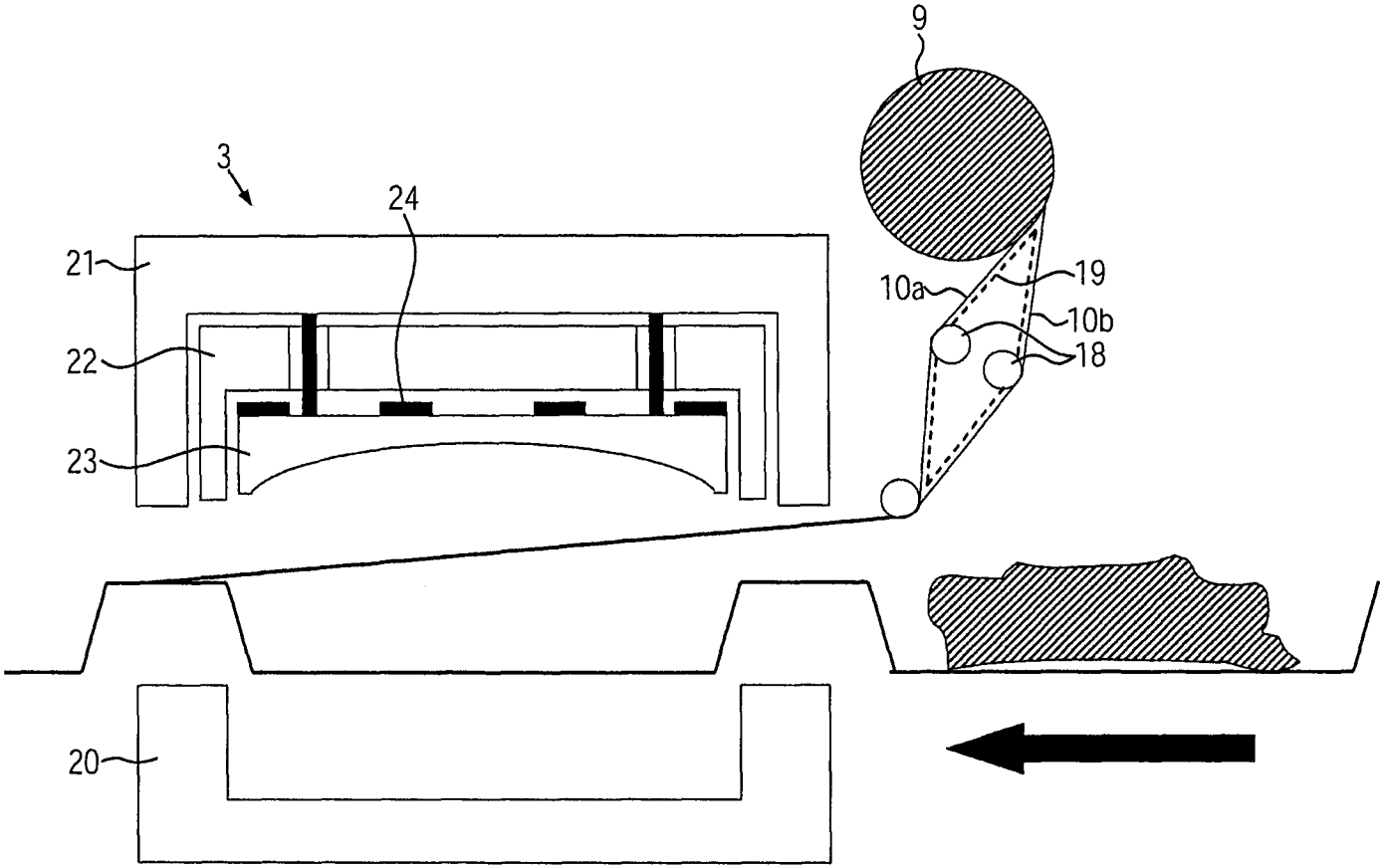
FIG. 2 is a schematic side view in the region of the sealing station of a packaging machine according to the invention with the sealing station being opened.

While the means 11 may comprise any suitable spacing device or separation device, in the embodiment shown in FIG. 2, the means 11 is represented in a form in which two rollers 18 take care of a changing distance 12. This distance 12 is accomplished downstream of the web accumulator 9 by a separate course of the outer layer 10*a* of the lid foil 10 and the inner layer 10*b* of the lid foil 10 over the rollers 18. Downstream of the rollers 18, the course of both layers towards the sealing station 3 is again brought together.

Spacer elements 19, for example cornstarch grains which are located between the outer layer 10*a* of the lid foil 10 and the inner layer 10*b* of the lid foil 10, can be either located on only one side of the outer layer 10*a* of the lid foil 10 or of the inner layer 10*b* of the lid foil 10, or on both sides. The spacer elements on the one hand permit the function of a facilitated separation of the outer layer 10*a* of the lid foil 10 and the inner layer 10*b* of the lid foil 10 due to the low adhesion, and on the other hand also a spacing after the outer layer 10*a* of the lid foil 10 and the inner layer 10*b* of the lid foil 10 have been brought together in the sealing station, so that oxygen can also diffuse between the outer layer 10*a* of the lid foil 10 and the inner layer 10*b* of the lid foil 10 in the finished package.

The opened sealing station 3 with an upper sealing tool part 21 and a lower sealing tool part 20 includes a sealing plate 22 in the upper sealing tool part 21 and a heating plate 23 fixed to the upper sealing tool part 21. Between the upper sealing tool part 21, the sealing plate 22 and the heating plate 23, insulating air gaps are located. In the represented embodiment, contact elements 24 are attached to the heating plate 23. The sealing plate 22 can be moved relative to the upper sealing tool part 21 and the heating plate 23.

Figure 3:
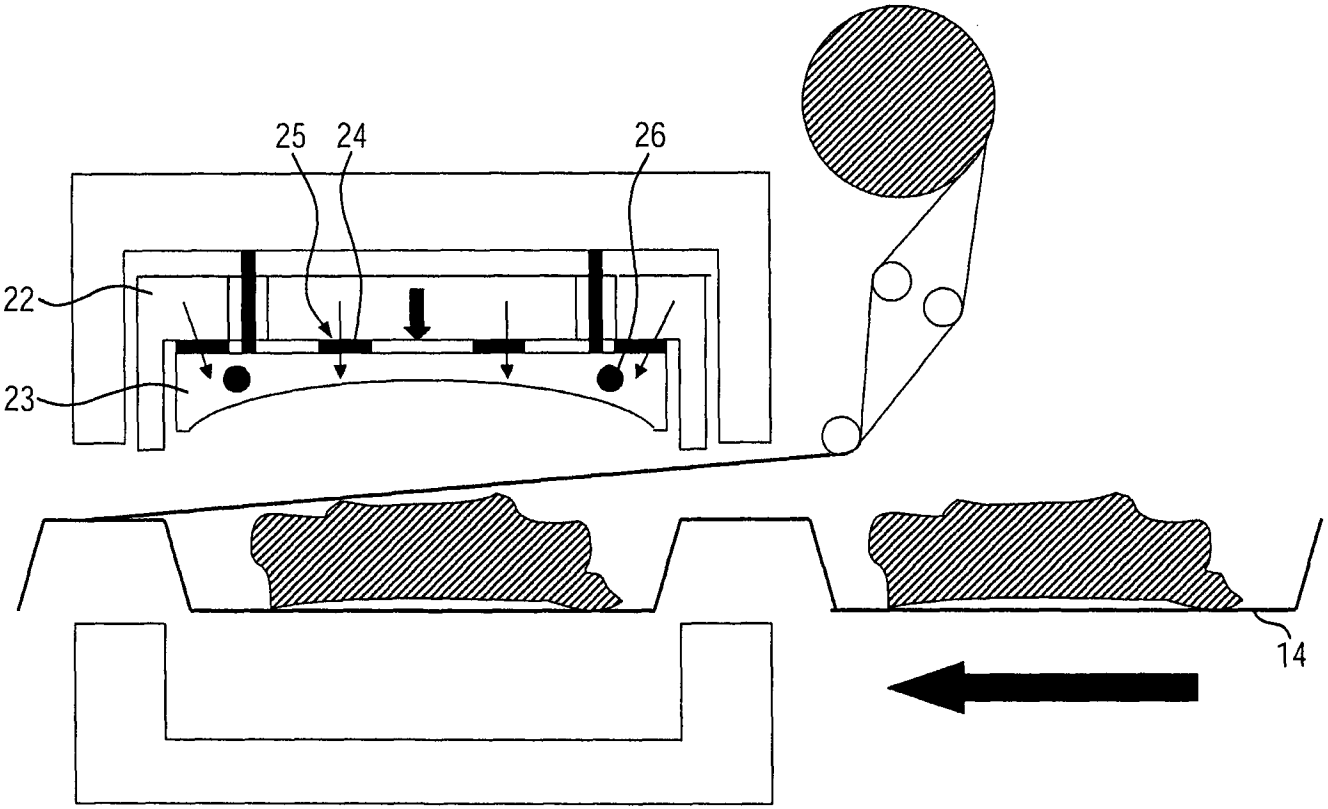
FIG. 3 is a schematic side view in the region of the sealing station of a packaging machine according to the invention and a representation of the thermal transfer.

FIG. 3 shows the process of heating of the heating plate 23. The sealing plate 22 has moved towards the heating plate 23 until the sealing plate 22 comes into contact 25 with the contact elements 24 on the heating plate 23. Via this contact 25, the thermal transfer by heat conduction from the sealing plate 22 to the heating plate 23 is realized. Sensors 26 determine the temperature of the heating plate 23 and forward this information to the controlling means 17. The controlling means 17 ensures that the contact 25 is maintained until the required temperature is achieved and correspondingly initiates the further processes. It also takes care that the contact of the sealing plate 22 is performed by the movement towards the heating plate 23.

Figure 4:
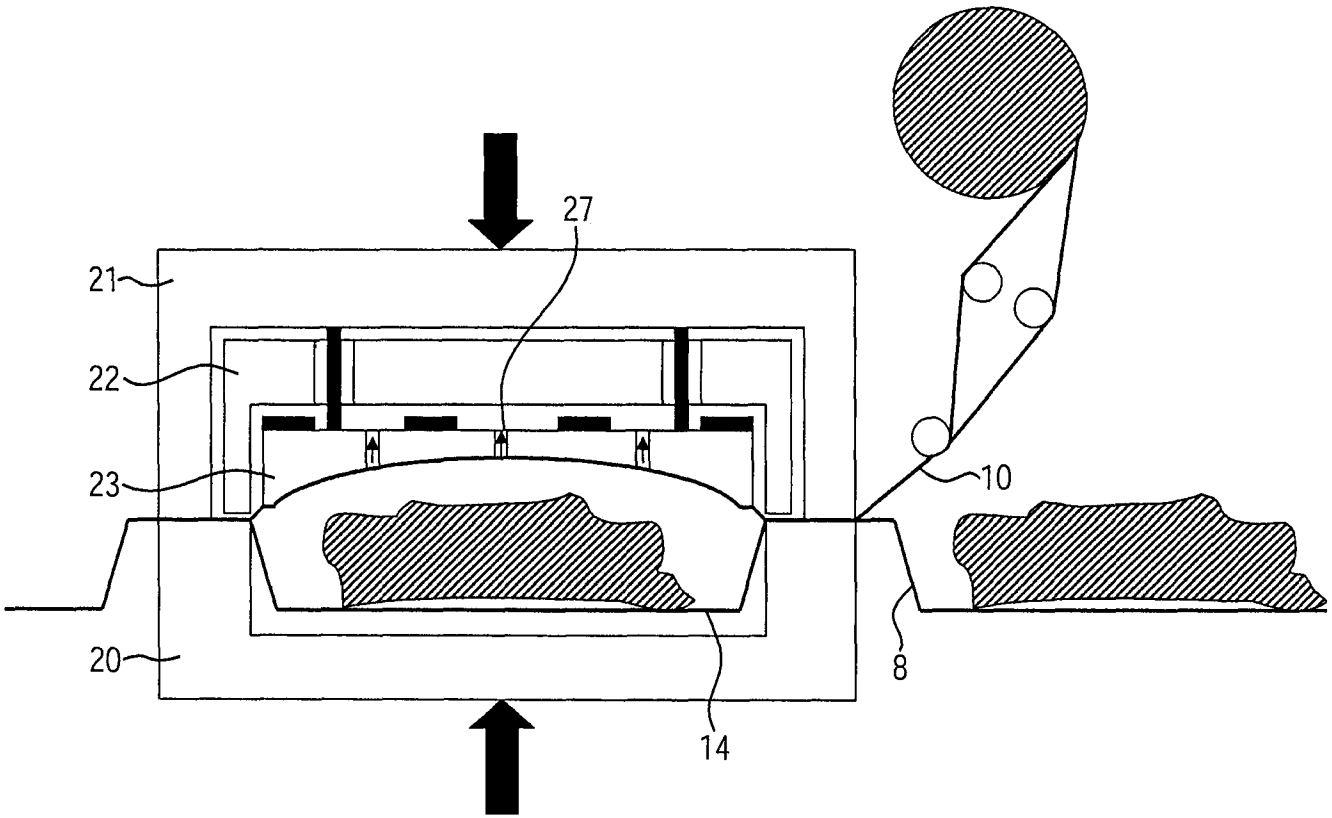
FIG. 4 is a schematic side view in the region of the sealing station of a packaging machine according to the invention and a representation of the closed sealing station.

A next process step is the further transport of the first web-like material 8 with the filled containers 14. Subsequently, as is shown in FIG. 4, the lower sealing tool part 20 and the upper sealing tool part 21 move together, in the process clamp the first web-like foil web 8 and the second web-like material 10 on all sides in the outer region, and a chamber is formed.

To place the second web-like material 10 against the heated heating plate 23, a vacuum is created between the second web-like material (i.e. the lid foil) 10 and the heating plate 23 via vacuum lines 27. This causes an attraction and subsequently a location of the second web-like material 10 against the heating plate 23 for heating the second web-like material 10. The volume under the second web-like material 10 and the container 14 can now be modified; in particular by evacuation and subsequent (re)gasification by gas exchange to achieve an oxygen content of more than 60 percent by volume for fresh meat products.

Figure 5:
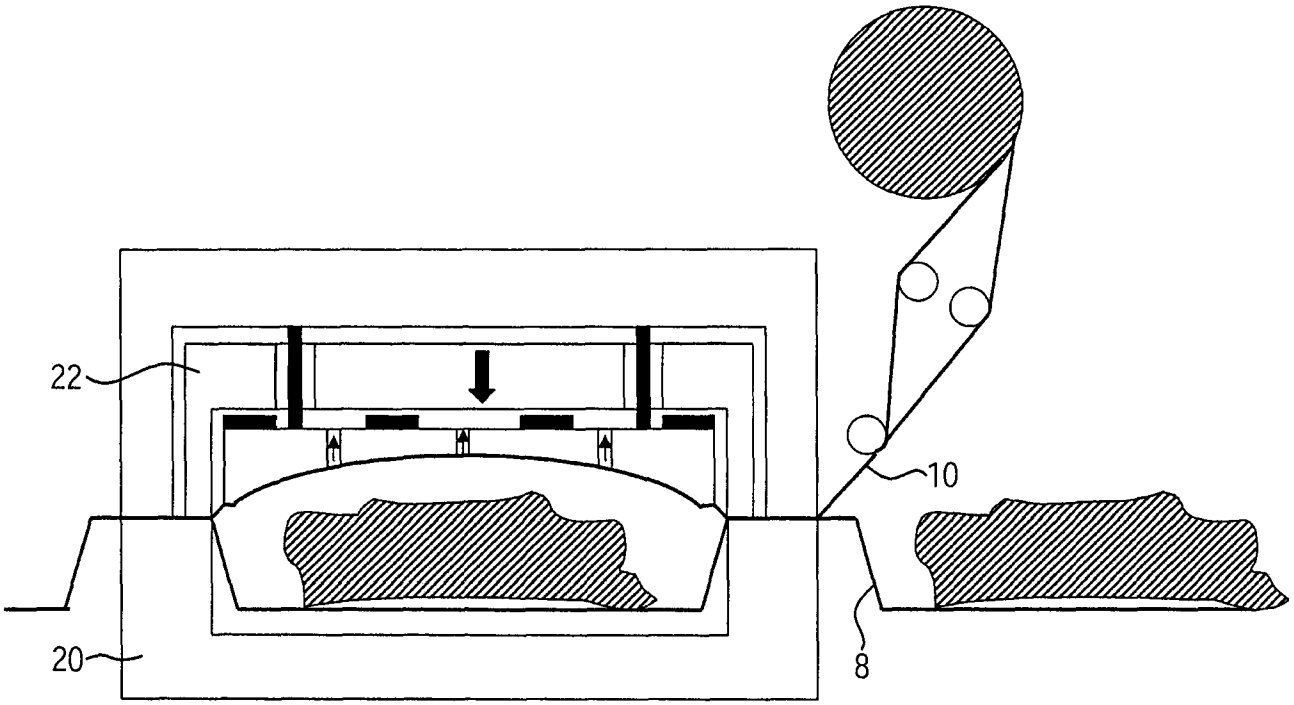
FIG. 5 is a schematic side view in the region of the sealing station of a packaging machine according to the invention during the heating of the lid foil and sealing.

FIG. 5 shows that the sealing plate 22 is moved towards the lower sealing tool part 20 and clamps the two web-like materials 8 and 10 for the sealing operation. In this relative movement of the sealing plate 22 to the heating plate 23, there is no further contact of the sealing plate 22 and the heating plate 23.

Figure 6:
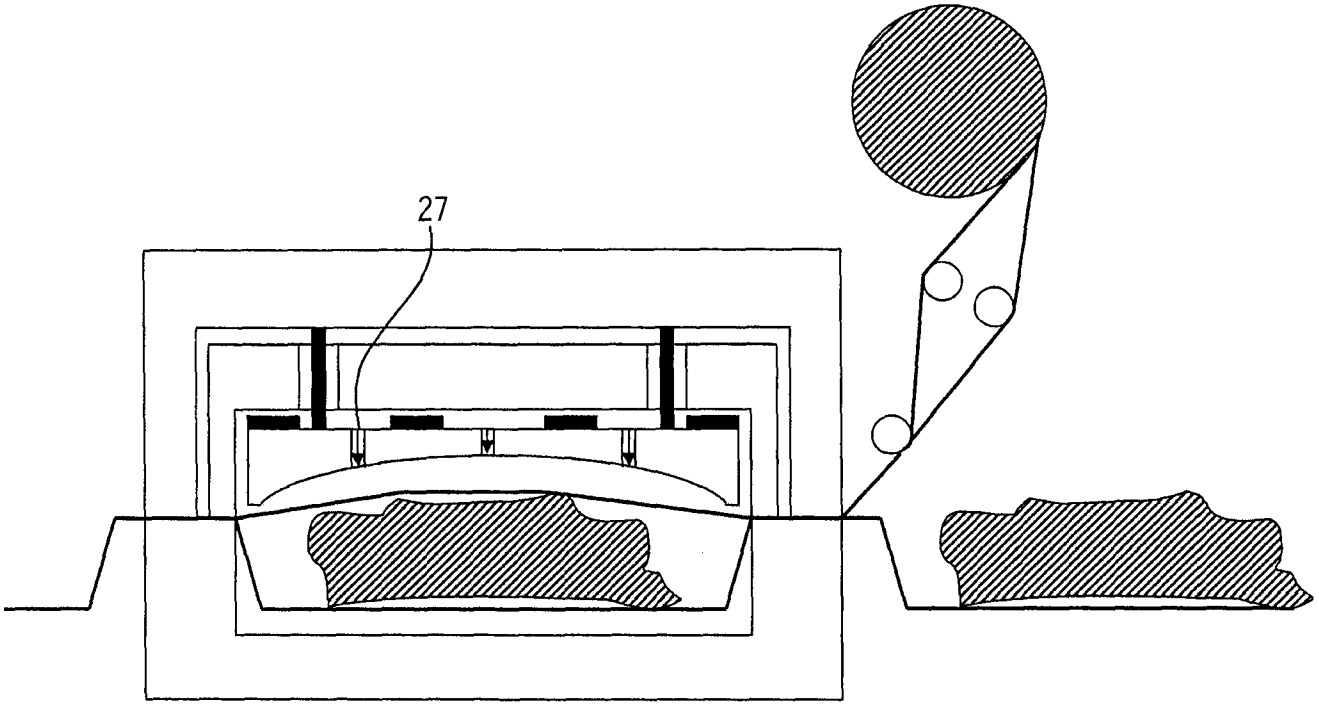
FIG. 6 is a schematic side view in the region of the sealing station of a packaging machine according to the invention and a representation during aeration.

After the sealing of the first web-like material 8 with the second web-like material 10, the chamber is aerated, as is represented in FIG. 6, e.g. by opening the vacuum lines 27 to the surrounding atmosphere. This leads to the heated foil 10 lying against the product at least in some areas as a "second skin" and thus an optically attractive package being created due to the differential pressure between the interior of the container and the surrounding area and/or the shrinking capacity of the second web-like material 10.

Figure 7:
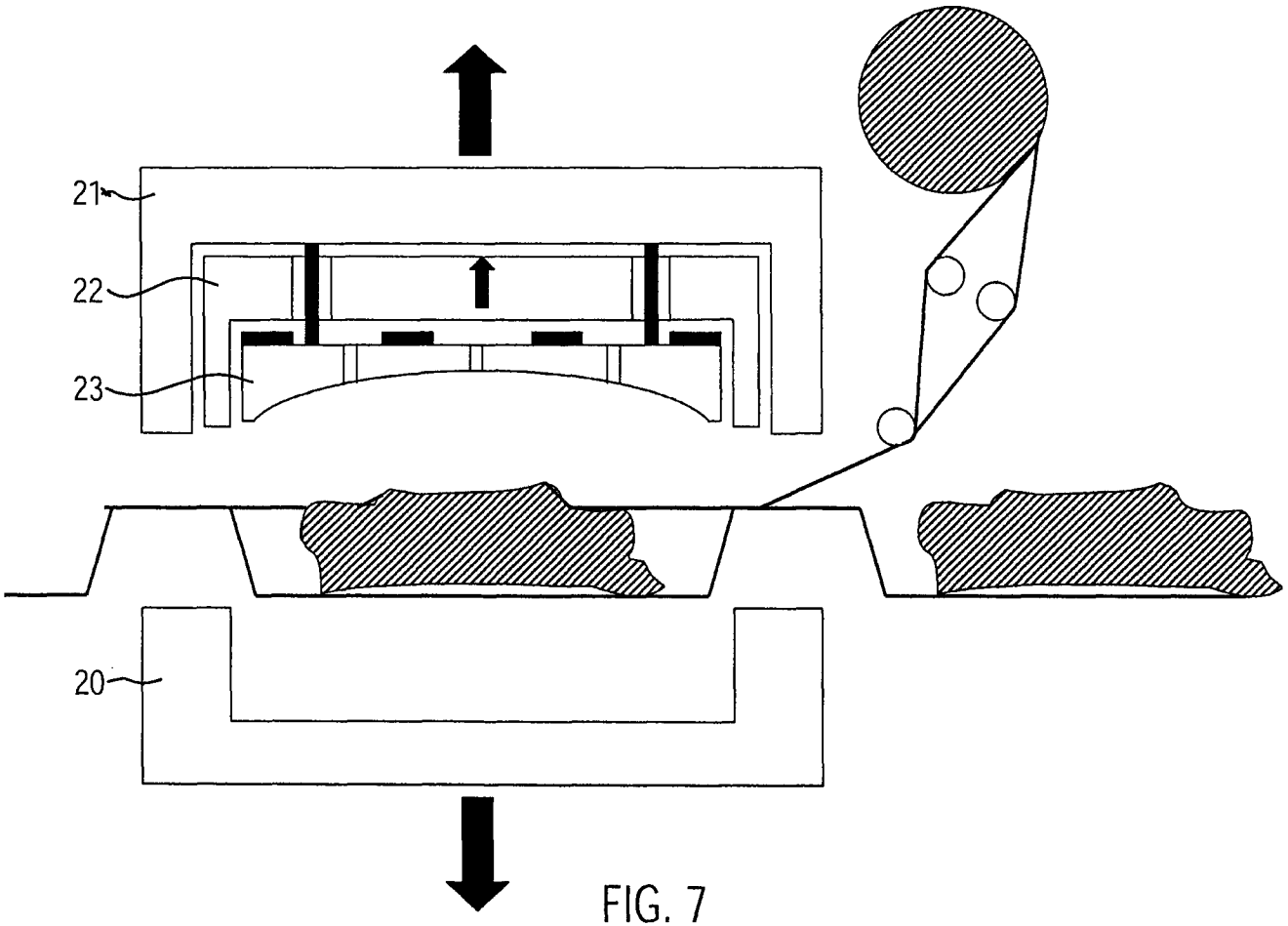
FIG. 7 is a schematic side view in the region of the sealing station of a packaging machine according to the invention and a representation of the opened sealing station and the packed product.

In FIG. 7, the lower sealing tool part 20 and the upper sealing tool part 21 with the sealing plate 22 and the heating plate 23 move away from each other and open the chamber for the next cycle.

The invention is not restricted to the shown embodiment but permits various changes or variations, including the following other alternatives.

If quick cooling is required, the heating plate 23 can also additionally include a cooling means, e.g. water cooling. A cooling means can also prevent overheating of the heating plate 23.

Separate heating elements can also be mounted in or at the heating plate 23, taking care of the required heating of the heating plate via the controlling means 17.

The contact elements 24 can also be designed to be flexibly compressible in the moving direction of the sealing plate 22, such as e.g. by pressure springs, to permit an even easier relative positioning of the sealing plate 22 with respect to the heating plate 23 and also a thermal transfer before or during the sealing process while the chamber is closed.

The contact elements 24 themselves can also be movable individually and/or together relative to the sealing plate 22 and/or the heating plate 23.

The present disclosure provides a packaging machine in which the spacing of the layers of a multilayer lid foil after the unreeling of the foil and the again joint feed into the sealing station leads to an air cushion being formed between the two layers, that there is a better oxygen distribution within the lid foil or a better supply of oxygen from the package interior after the closing of the package and the placing against the product projecting over the sealing level, and thus the negative discoloration is even further reduced or the reddening is better maintained over a longer period.

Especially for products that project over the sealing level 28 of the containers 14, a gas cushion is required between two layers of a lid foil, so that due to the oxygen permeability of the inner layer 10*b* of the lid foil 10, the oxygen can also reach those points where at least the inner layer 10*b* of the lid foil 10 lies against the product 16 and thus a transfer of the oxygen to the product 16 can be effected and discoloration is prevented or minimized, respectively.

The packaging machine is not only restricted to a deep-drawing packaging machine. For example, the packaging machine can also be a tray sealer.

While exemplary embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A deep-drawing packaging machine comprising:

a forming station for forming containers in a first web-like material;

an insertion section for inserting products which reach at least one sealing level or project over it;

a sealing station arranged downstream of the insertion section in a working direction which is embodied to seal a second web-like material onto the containers, wherein the second web-like material comprises multiple layers; and a spacing device for changing a distance between layers of the second web-like material to form a gas cushion between the layers.

2. The deep-drawing packaging machine according to claim 1 wherein the spacing device is configured to reduce the distance between the layers in the direction of transport.

3. The deep-drawing packaging machine according to claim 1 wherein the spacing device is configured to first increase and subsequently reduce the distance between the layers.

4. The packaging machine according to claim 3 wherein the spacing device is located upstream of the sealing station and comprises two spaced apart rollers.

5. The deep-drawing packaging machine according to claim 1 further comprising a web accumulator for supplying at least one layer of the second web-like material, and wherein the spacing device is arranged in a region of the web accumulator and the sealing station.

6. The deep-drawing packaging machine according to claim 1 further comprising a web accumulator for supplying the multiple layers of the second web-like material.

7. The deep-drawing packaging machine according to claim 1 wherein spacer elements are present between two adjacent layers of the second web-like material.

8. The deep-drawing packaging machine according to claim 1 wherein the forming station is configured to form the containers such that each container has an essentially U-shaped edge.

9. The deep-drawing packaging machine according to claim 1 wherein the sealing station is embodied as a closable chamber with modifiable atmosphere.

10. The deep-drawing packaging machine according to claim 1 further comprising a cutting station arranged downstream of the sealing station in the working direction, wherein the cutting station is configured to cut the containers out of the first web-like material.

11. A deep drawing packaging machine comprising:

a forming station for forming containers in a first web-like material such that each container has a sealing level;

an insertion section for inserting products into the containers such that the products project over the sealing levels;

a sealing station arranged downstream of the insertion section in a working direction, the sealing station comprising a heating plate that is heatable in a controlled manner for heating a second web-like material, a sealing plate for sealing the second web-like material onto the containers, and at least one contact element for thermal transfer via heat conduction provided between the sealing plate and the heating plate, wherein the second web-like material is an at least two-layered web-like material; and a device for changing a distance between two layers of the second web-like material to form a gas cushion between the two layers.

12. The packaging machine according to claim 11 wherein the at least one contact element is configured to provide releasable contact between the sealing plate and the heating plate.

13. The packaging machine according to claim 12 wherein the sealing plate is movable in a first direction, and the at least one contact element includes multiple contact elements that are flexibly compressible in the first direction.

14. The packaging machine according to claim 13 wherein the compressible contact elements are configured as pressure springs.

15. The packaging machine according to claim 12 wherein the at least one contact element includes multiple contact elements that are individually and/or commonly movable relative to the sealing plate and/or the heating plate to provide the releasable contact between the sealing plate and the heating plate.

16. The packaging machine according to claim 11 wherein the heating plate, the sealing plate and/or the at least one contact element can be moved relative to each other.

17. The packaging machine according to claim 11 wherein the heating plate is embodied for heating the second web-like material by contact.

18. The packaging machine according to claim 11 further comprising at least one vacuum line for creating a vacuum between the second web-like material and the heating plate.

19. The packaging machine according to claim 11 further comprising at least one sensor for temperature measurement in or at the heating plate.

20. The packaging machine according to claim 11 further comprising a controller for controlling the heating of the heating plate.

21. The packaging machine according to claim 20 further comprising at least one sensor for temperature measurement in or at the heating plate, wherein the at least one sensor is connected to the controller.

22. The packaging machine according to claim 11 wherein the sealing station is embodied as a closable chamber with modifiable atmosphere.

23. The packaging machine according to claim 11 further comprising a cutting station arranged downstream of the sealing station in the working direction, the cutting station being configured for cutting a container out of the first web-like material and/or the second web-like material.

24. The packaging machine according to claim 11 wherein the device is provided for reducing the distance between the two layers in the working direction.

25. The packaging machine according to claim 11 wherein the device is configured to first increase and subsequently reduce the distance between the two layers.

26. The packaging machine according to claim 25 wherein the spacing device is located upstream of the sealing station and comprises two spaced apart rollers.

27. The packaging machine according to claim 11 further comprising a web accumulator for supplying at least one layer of the second web-like material, and wherein the device is arranged in a region of the web accumulator and the sealing station.

28. The packaging machine according to claim 11 wherein the at least two layers of the second web-like material are located in a common web accumulator.

29. The packaging machine according to claim 11 wherein spacer elements are present between two adjacent layers of the second web-like material.

30. The packaging machine according to claim 11 wherein the forming station is configured to form the containers such that each container has an essentially U-shaped edge.

31. The packaging machine according to claim 11 wherein the heating plate comprises a cooling means.

32. The packaging machine according to clam 11 further comprising multiple heating elements mounted in or at the heating plate.

33. A packaging machine comprising:

an insertion section for inserting products into containers; and a sealing station arranged downstream of the insertion section in a working direction, the sealing station comprising a heating plate that is heatable in a controlled manner for heating a web-like material, a sealing plate for sealing the web-like material onto the containers, and at least one contact element for thermal transfer via heat conduction provided between the sealing plate and the heating plate, wherein the sealing plate is movable in a first direction, and the at least one contact element is flexibly compressible in the first direction.

34. The packaging machine of claim 33 wherein the at least one contact element comprises multiple contact elements.

35. The packaging machine of claim 33 wherein the at least one contact element is configured to provide releasable contact between the sealing plate and the heating plate.

* * * * *